US011305547B2

(12) United States Patent
Fitzgerald et al.

(10) Patent No.: US 11,305,547 B2
(45) Date of Patent: Apr. 19, 2022

(54) ELECTRICAL CONTACTS COUPLED TO GUIDE STRUCTURES

(71) Applicant: Hewlett-Packard Development Company, L.P., Spring, TX (US)

(72) Inventors: Sean Daniel Fitzgerald, Boise, ID (US); Jeffrey H. Luke, Boise, ID (US); Mathew Lavigne, Boise, ID (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/047,886

(22) PCT Filed: Aug. 30, 2018

(86) PCT No.: PCT/US2018/048783
§ 371 (c)(1),
(2) Date: Oct. 15, 2020

(87) PCT Pub. No.: WO2020/046326
PCT Pub. Date: Mar. 5, 2020

(65) Prior Publication Data
US 2021/0155004 A1 May 27, 2021

(51) Int. Cl.
*B41J 2/175* (2006.01)

(52) U.S. Cl.
CPC ..... *B41J 2/17526* (2013.01); *B41J 2/1752* (2013.01); *B41J 2/17509* (2013.01); *B41J 2/17523* (2013.01); *B41J 2/17546* (2013.01)

(58) Field of Classification Search
CPC .... B41J 2/175; B41J 2/17506; B41J 2/17509; B41J 2/17513; B41J 2/1752; B41J 2/17523; B41J 2/17526; B41J 2/17546; G03G 15/0863
See application file for complete search history.

(56) References Cited

U.S. PATENT DOCUMENTS 5,992,975 A 11/1999 Gasvoda et al.
6,168,262 B1 1/2001 Clark et al.
6,302,535 B1 10/2001 Sturgeon et al.
(Continued)

FOREIGN PATENT DOCUMENTS

EP 2 261 751 A2 12/2010
EP 2 367 068 A2 9/2011
(Continued)

*Primary Examiner* — Anh T Vo
(74) *Attorney, Agent, or Firm* — Jefferson IP Law, LLP

(57) ABSTRACT

In an example, a print component includes a guide structure. The example guide structure includes a recess to receive a print material container and a guideway with a guide wall to support rotation of the print material container. Upon rotation of the print material container, an electrical contact of the print material container moves towards an electrical contact coupled to the guide structure of the print component. In another example, a container includes a housing, a material transfer interface, and a mechanical interface. In that example, the mechanical interface includes a guide structure that defines a protrusion and a guideway to allow the container to rotate within a recess defined by a receptacle shell. Upon rotation of the container, an electrical contact coupled to the guide structure moves towards an electrical contact on the receptacle shell.

16 Claims, 7 Drawing Sheets

(56) References Cited

U.S. PATENT DOCUMENTS

| | | | | |
|---|---|---|---|---|
| 6,505,926 | B1 | 1/2003 | Trafton et al. | |
| 6,588,880 | B1 | 7/2003 | Gasvoda et al. | |
| 7,008,053 | B2 * | 3/2006 | Hashii | B41J 2/1753 347/86 |
| 7,533,905 | B2 | 5/2009 | Jackson et al. | |
| 7,837,310 | B2 | 11/2010 | Higginson et al. | |
| 7,950,789 | B2 | 5/2011 | Matsumoto et al. | |
| 8,590,742 | B2 | 11/2013 | Devos et al. | |
| 9,694,588 | B2 * | 7/2017 | Shiota | B41J 2/17553 |
| 2004/0135857 | A1 * | 7/2004 | Hashii | B41J 2/17503 347/86 |
| 2005/0007420 | A1 * | 1/2005 | Ogawa | B41J 2/17526 347/50 |
| 2013/0182048 | A1 | 7/2013 | Nozawa et al. | |
| 2017/0348975 | A1 | 12/2017 | Murphy et al. | |

FOREIGN PATENT DOCUMENTS

| | | | |
|---|---|---|---|
| WO | WO-98/55318 | | 12/1998 |
| WO | WO-2011/155642 | A1 | 12/2011 |
| WO | WO-2015/112501 | A1 | 7/2015 |

* cited by examiner

ELECTRICAL CONTACTS COUPLED TO GUIDE STRUCTURES

BACKGROUND

Images are processed for use with computing machines, such as a print apparatus. A print apparatus, for example, may use control data based on processed image data to produce a physical representation of an image by operating a print material placement system according to the control data. The print apparatus may include a print material receiving station to receive a container of print material to use in producing the physical representation.

DETAILED DESCRIPTION

Figure 1A:
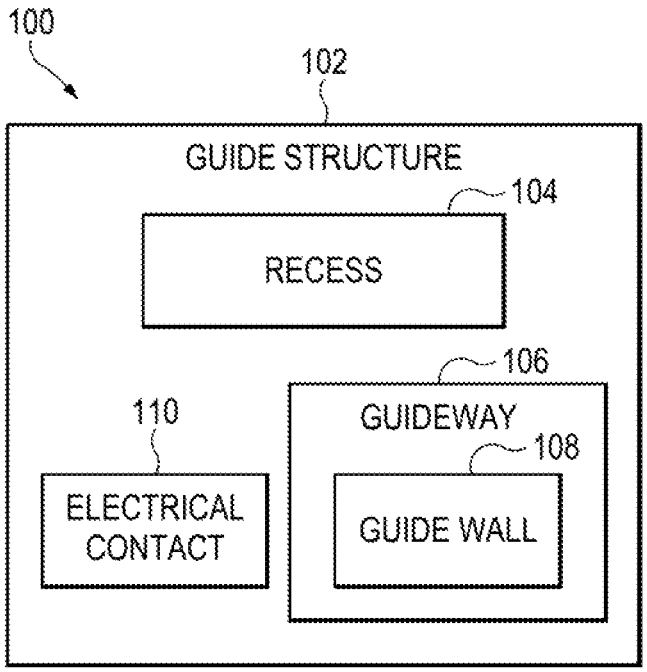
FIGS. 1A and 2A are block diagrams depicting example print components.

In the following description and figures, some example implementations of print apparatus, print components, and print material containers are described. In examples described herein, a "print apparatus" may be a device to print content on a physical medium (e.g., paper, textiles, a layer of powder-based build material, etc.) with a print material (e.g., ink or toner). In some examples, the physical medium printed on may be a web roll or a pre-cut sheet. In the case of printing on a layer of powder-based build material, the print apparatus may utilize the deposition of print materials in a layer-wise additive manufacturing process. A print apparatus may utilize suitable print consumables, such as ink, toner, fluids, powders, or other raw materials for printing. In some examples, a print apparatus may be a three-dimensional (3D) print apparatus. An example of print material is powder toner heatable by a heat transfer device, such as carbon-based toner, plastic-based toner, or a plant-derived toner heatable by a laser or fuser. Another example of fluid print material is a water-based latex ink ejectable from a print head, such as a piezoelectric print head or a thermal inkjet print head. Other examples of print fluid may include dye-based color inks, pigment-based inks, solvents, gloss enhancers, fixer agents, and the like. Toner and 3D-print powder are examples of print materials that are particles (i.e., print particles). Some print particles, such as 3D-print particles may have an average diameter of 50 microns, where other print particles, such as laser toner particles, may have an average diameter of 20 microns. The print material container may be a print particle container to provide a supply of print particles to a host device. For example, the print material container may be a print particle supply container to supply print particles to a print particle receptacle of a print system.

In some example print apparatus, an exchangeable and/or rechargeable print material container may be used. The print material container may be attachable and detachable to a print component coupleable to a print apparatus. For example, a toner vessel may be charged and connected to a toner cartridge that is insertable into a toner receiving station of a laser print apparatus. The print component may be a component of a printer such as a print cartridge or a print receptacle that receives a container of print material. The print component may be attachable (e.g., a replaceable part) to a print apparatus or integral to a printer structure (e.g., a fixed part). The print material container may be sealingly connectable to the print apparatus (via the print component) to provide print material from the print material container to the print apparatus to use in a printing operation. The print component and/or the print apparatus may utilize information about the print material vessel and/or print component in an operation of the print apparatus. For example, a print cartridge may feature an electronic chip (e.g., a memory resource) attached, after assembly, to a print cartridge that is capable of reporting data and/or record data. The mechanical interface of the container may influence the electrical connection of the container with the cartridge. A poor electrical connection with the print material container may fail to provide data useable for the cartridge and/or the print apparatus.

Various examples described below relate to an interface between a print component and a print material container with a guideway that guides electrical contacts towards a connection location upon rotation of the print material container. By providing a mechanical interface to assist rotation, the print material container may securely generate an electrical connection with the print component.

Figure 1B:
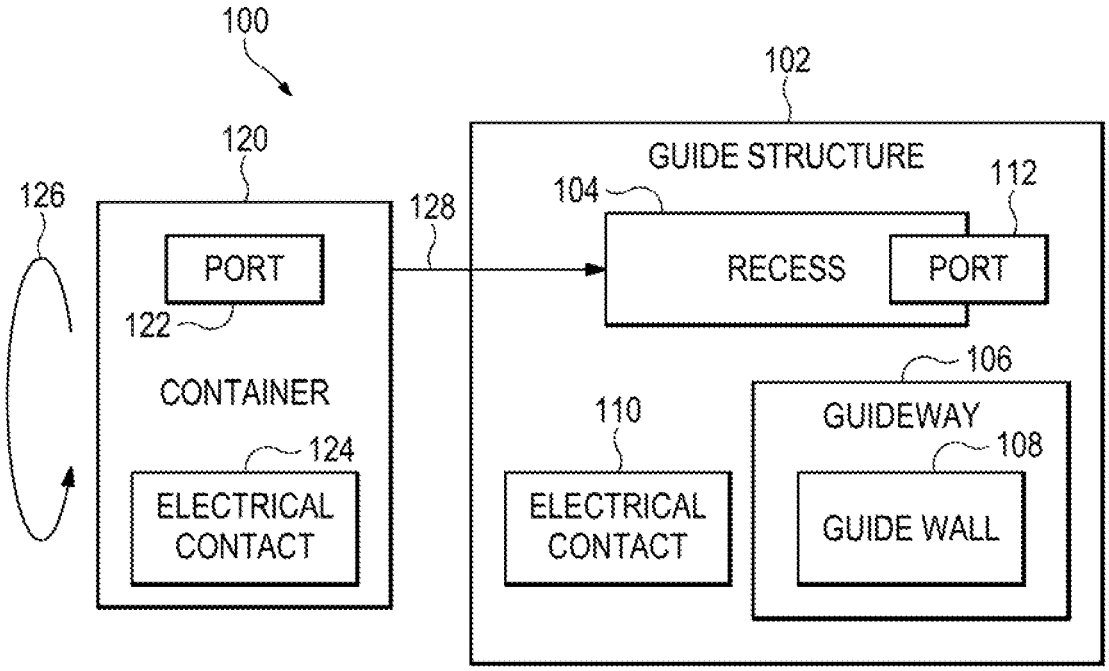
FIGS. 1B and 2B are block diagrams depicting example print material containers coupled to example print components.
Figure 2A:
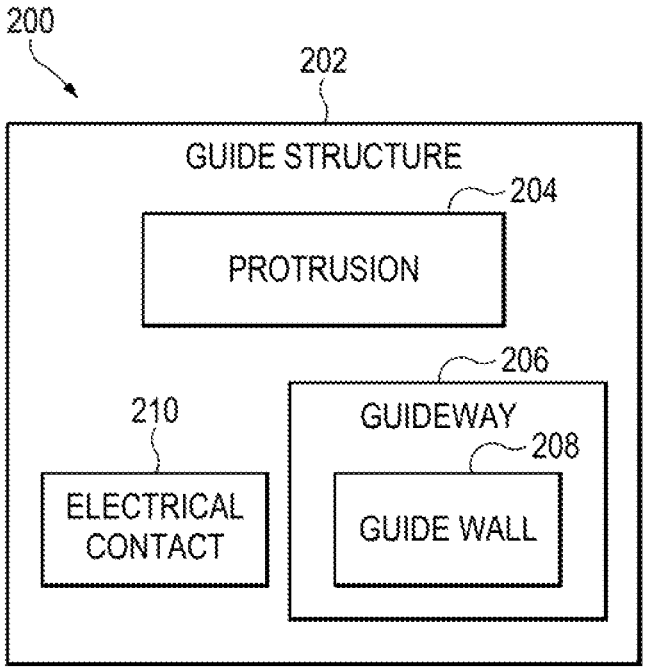
Figure 2B:
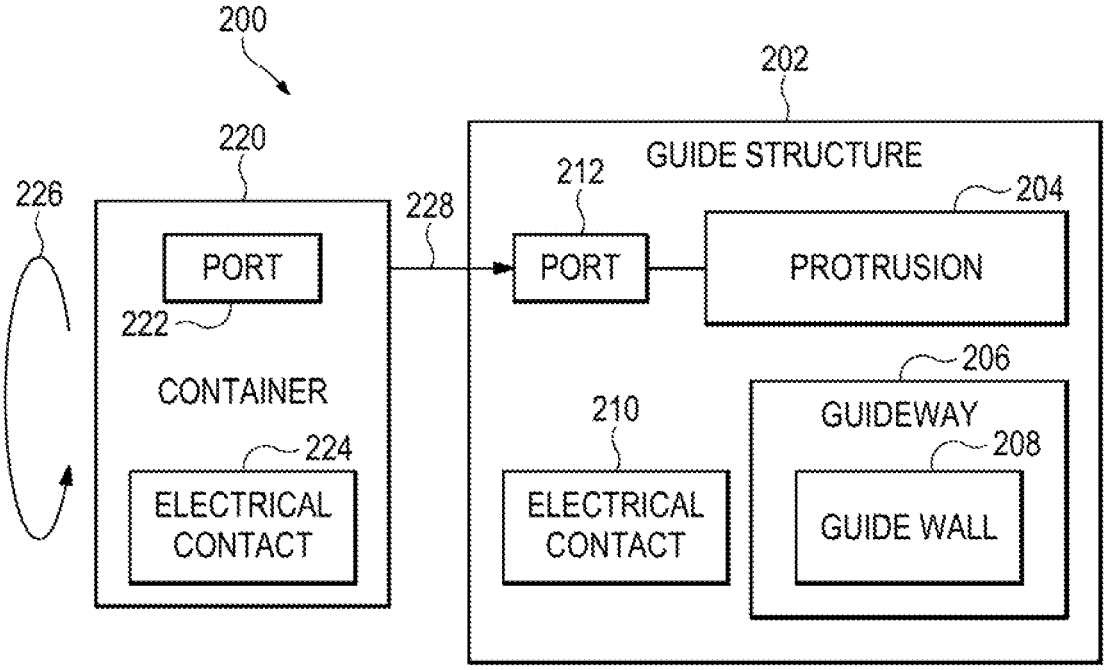

FIGS. 1A and 2A are block diagrams depicting example print components 100 and 200. FIGS. 1B and 2B are block diagrams depicting example print material containers 120 and 220 coupled to example print components 100 and 200 respectively. The print components discussed herein may be referred to as example components, such as cartridges or receptacles to receive a container and/or provide a supply of print material to a print apparatus.

Referring to FIG. 1A, the print component 100 generally includes a guide structure 102 with features to assist forming an electrical connection. For example, the guide structure 102 may include an interface, such as a recess 104 and a guideway 106, to couple to a print material container to the print component 100. The interface assists forming an electrical connection between the print material container and the print component 100 with an electrical contact 110 coupled to the guide structure 102. The electrical contact 110 may be exposed on a surface of the guide structure 102 to allow for electrical connection to be made with the electrical contact 110. For example, the electrical contact 110 may also be partially embedded in the housing 106 with a surface exposed on the exterior facing surface to allow for external electrical connection. The electrical contact 110 may be made of any appropriate conductive material to form an electrical connection, such as beryllium copper. A single element depicted in any of the figures herein may represent a plurality of that element except where stated otherwise.

The recess 104 of FIGS. 1A and 1B forms an interface to receive a print material container 120 in a placement direction 128. The placement direction may be towards a docked position of the print material container 120 where the print material container 120 is securely connected within the recess 104 to the print component 100 to transfer print material to the print component 100, for example. The recess 104 may guide the print material container to a port 112 in the placement direction 128 as shown in FIG. 18, where upon rotation 126 of the container 120 (as guided by the guideway 106), an electrical contact 124 moves towards electrical contact 110 to connect and form an electrical connection.

As used herein, a guideway is a track along which something moves. For example, the guideway 106 may be a groove that receives a guideway counterpart (e.g., a protruding feature that fits in the guideway) of a print material container and allows the guideway counterpart of the print material container to move along the groove. The guideway may be a recessed path or cavity that allows for translational and/or rotational movement along the path or within the cavity. The guideway 106 includes a guide wall 108. The guide wall 108 supports rotation of the print material container about an axis. The rotation about an axis may be centric or eccentric with respect to the print material container and/or the print cartridge receiving area.

The guide wall 108 of the guide structure may be part of a housing of the container 100. As examples, the guide wall 108 may be a sidewall of the housing, a wall of a floor or ceiling of a cavity in the housing, a wall of a lip of an opening of the housing, a periphery of an enclosure of the housing, a physical divider of interior space within the housing, a protrusion extending from the housing, a protrusion extending into the housing, a portion of a unibody structure of the housing, and the like.

The guide wall 108 may contain an electrical lead coupled to the electrical contact 110. The electrical lead may be formed of any appropriate electrically conductive material to electrically couple to the electrical contact 110. The electrical lead may be embedded in the guide wall 108 of the housing where the length of the electrical lead corresponding to the guide wall 108 is fully enclosed by material of the guide wall 108 or located within a channel defined through the guide wall 108 in which the electrical lead fits. The electrical contact 110 is coupled to the housing and located on the exterior of the housing to allow for an electrical contact point.

The print material container 120 and the print component 100 may include a material transfer interface. For example, the print material container 120 may include a portion of the housing defining a port 122 to a print material chamber containing print material and the material transfer interface of the print component may include a portion of the guide structure 102 of the print component 100 defining a port 112 coupleable to port 122 of the print material container 120.

The print material container 120 may rotate upon insertion, rotate before insertion, rotate after insertion, or in conjunction with insertion. The rotation 126 of the print material container 120 may be about the axis of the material transfer interface. The rotation 126 of the print material container 120 may move the electrical contacts 110 and 124 towards each other and generate an electrical connection between the print material container 120 and the print component 100. The rotation 126 of the print material container 120 may generate pressure or otherwise form a seal between the print material container 120 and the print component 100 to transfer print material from the container 120 to the component 100.

Referring to FIGS. 2A and 2B, the print material transfer system operates generally the same as depicted in FIGS. 1A and 18, however, instead of a recess to guide the print material container in a placement direction, a protrusion 204 guides the print material container 220 in a placement direction 228 and the protrusion 204 defines a port 212 to receive print material from the printer material container 220. For example, the placement direction may be towards a docked position of the print material container 220 where the print material container 220 is securely connected over the protrusion 204 to the print component 200 to transfer print material to the print component 200, for example. In this manner, the print material container 220 may rotate about the protrusion 204 and the guide wall 208 guides the electrical contact 224 towards the electrical contact 210 concurrent to the rotation about the protrusion 204.

For example, the guide structure 202 may define a protrusion 204 in a placement direction 228 to receive a print material container 220 having an electrical contact 224 and define a guideway 206 adjacent the protrusion 204. In that example, the guideway 206 includes a guide wall 208 to support rotation of the print material container 220 about the protrusion 204 in the direction 226. In this manner, the guideway 206 guides the electrical contact 224 of the print material container 220 towards the electrical contact 210 of the print component 200 upon rotation of the print material container 220 about the protrusion 204 in the direction 226. In some examples, the guideway 206 includes an edge to guide coupling of the print material container 220 along the placement direction and the edge leads to the guide wall 208 of the guideway 206 to allow for rotation of the print material container 220 once a face of the print material container 220 contacts the guide wall 208 of the guideway 206.

For another example, a material transfer interface of the print component 200 may define a port 212 coupleable to a print material chamber of a print material container 220. In that example, the print material container 220 electrically couples to the print component 200 upon rotation 226 of the print material container 220 about the protrusion 204, and the print material container 220 sealingly couples to the print component 200 upon rotation 226 of the print material container about the protrusion 204. In this manner, the print material container 220 is electrically connected and sealed to the print component 200 concurrently, for example.

Figure 3C:
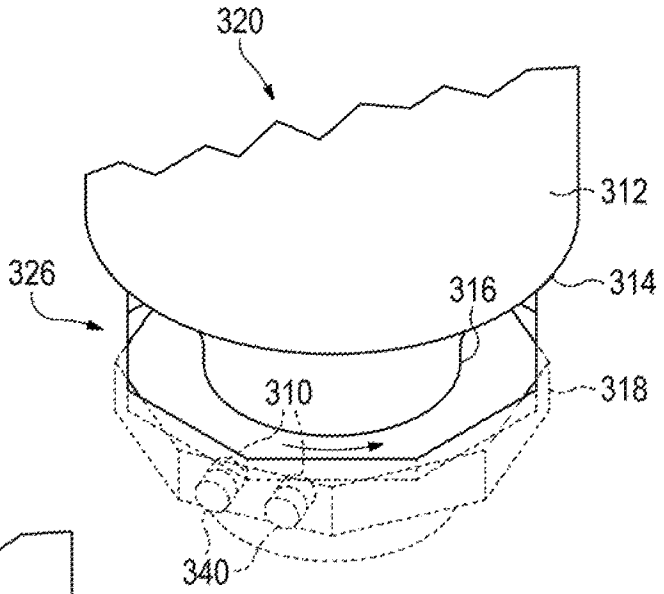
FIGS. 3A, 3B, 3C, 4, and 5 are isometric views of an example print material containers.
Figure 3B:
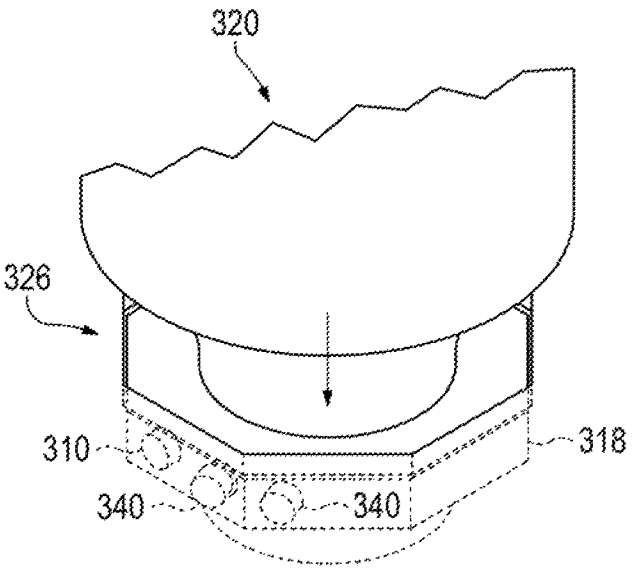
Figure 3A:
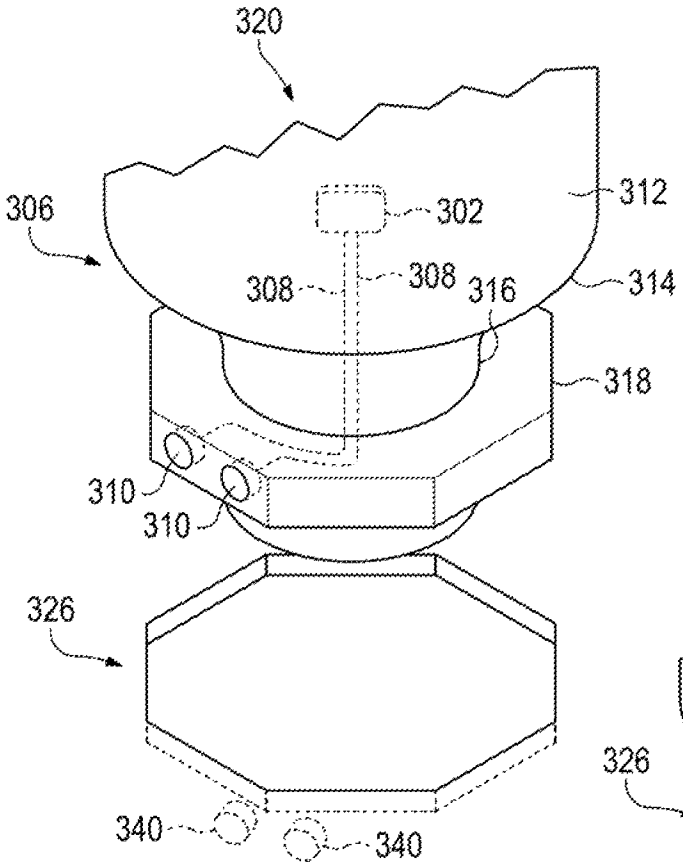

FIGS. 3A, 3B, 3C, 4, and 5 are isometric views of an example print material containers 320, 420, and 520. The print material containers generally include a housing with a print material chamber, a memory resource embedded in a wall of the housing, and an electrical contact electrically coupled to the memory resource, such as via an electrical lead. Referring to FIGS. 3A, 3B, 3C, 4, and 5, the print material containers generally include a housing defining a body, a neck, and a rim. The shape of the body, neck, and/or rim may act as a guideway or guideway counterpart to guide rotation of the print material container. In the example of FIGS. 3A-3C, the rim 318 may act as a guideway counterpart to move within the guide structure 326 of a print component to move electrical contacts 310 towards electrical contacts on the guideway and couple a port to a print material chamber that may be located within the body 314. The body 314 of FIG. 3A is depicted as generally tubular. In such an example, a cross-section of the tubular body may be any geometric shape. Other examples of body shapes include spherical, cuboid, a cube with rounded corners, a pyramid with rounded corners, and the like. In a similar fashion, neck shapes and rim shapes may be generally tubular with any number of geometric cross-sections (e.g., circle, square, triangle, rectangle with rounded corners, hexagon, etc.). The rim 318 defines a port coupled to the print material chamber located in the body 314. The neck 316 is coupled to the body 314 and the rim 318 is coupled to the neck 316. The body 314, neck 316, and rim 318 may include a channel, series of channels, or other interface to guide print material from the print material chamber to the port defined by the rim 318. The electrical contacts may be located on an exterior surface of the rim, neck, body, or other portion of the housing. A memory resource may be embedded in a wall of the body, a wall of the neck, or a wall of the rim. Example implementations are shown in FIGS. 3A, 38, 3C, 4, and 5.

Referring to FIG. 3A, the memory resource 302 is embedded in a wall 312 of the body 314 of the housing 306 of the container 320. Electrical contacts 310 are located on an exterior surface of the rim 318 facing away from the rim 318 on a side of the neck 316 and coupled to the memory resource 302 via electrical leads 308. The plurality of electrical contacts of the print component may be located adjacent to each other on a same side of the side wall of the recess to complement location of the electrical contacts 310 of the print material container 320. The rim 318 may define a port coupled to a channel in the neck 316 coupled to a print material chamber in the body 314. In this manner, the memory resource 302 may be embedded in a wall of the body 314 defining a chamber. The shape of the rim 318, the neck 316, and/or the body 314 may act as a guideway or guideway counterpart to support rotation of the print material container 320 about an axis in a placement direction.

Referring to FIGS. 38 and 3C, the print material container 320 is inserted into a guide structure 326 of a printer component. The print material container 320 is inserted until the rim 318 is within the cavity formed by the guide structure 326 of the print component and able to be rotated so that the electrical contacts 310 exposed on the rim 318 of the print material container 320 align with the electrical contacts 340 exposed on a surface of a guide structure 326 defining the recess of the print component. In this manner, the print component includes a guide structure 326 defining a recess and a guideway adjacent the recess to support rotation (e.g., as depicted in FIG. 3C) of the print material container 320 about an axis of the placement direction (e.g., as depicted in FIG. 38), and the print component includes a plurality of electrical contacts 340 coupled to the recessed container receiving area (e.g., the guide structure 326) towards which move the electrical contacts 310 upon rotation of the print material container 320.

Figure 4:
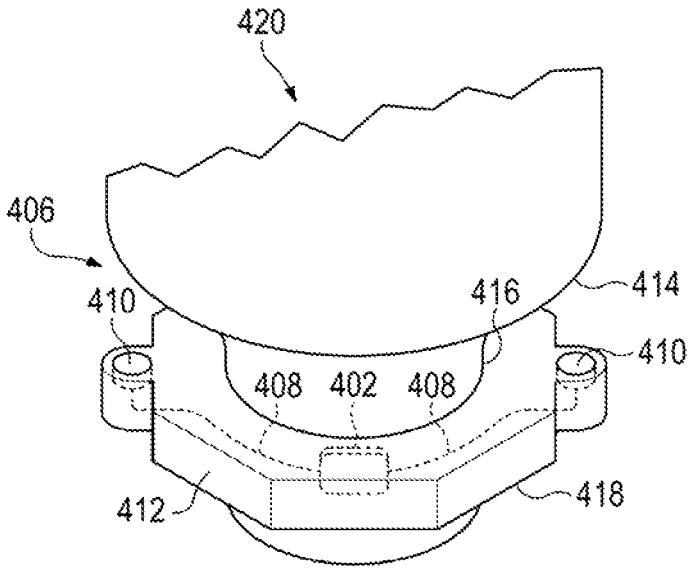

Referring to FIG. 4, the memory resource 402 is embedded in a wall 412 of the rim 418 of the housing 406 of the container 420. Electrical contacts 410 are symmetrically located on an exterior surface of the rim 418 towards the body 414 on opposing sides of the neck 416 and coupled to the memory resource 402 via electrical leads 408. The plurality of electrical contacts of the print component may be located across from each other on substantially opposing side walls of the recess to complement the location of the electrical contacts 410 of the print material container 420. The rim 418 may define a port coupled to a channel in the neck 416 coupled to a print material chamber in the body 414. In this manner, the memory resource 402 may be embedded in a wall of the rim 418 defining a port. The shape of the rim 418, the neck 416, and/or the body 414 may act as a guideway or guideway counterpart to support rotation of the print material container 420 about an axis in a placement direction.

Figure 5:
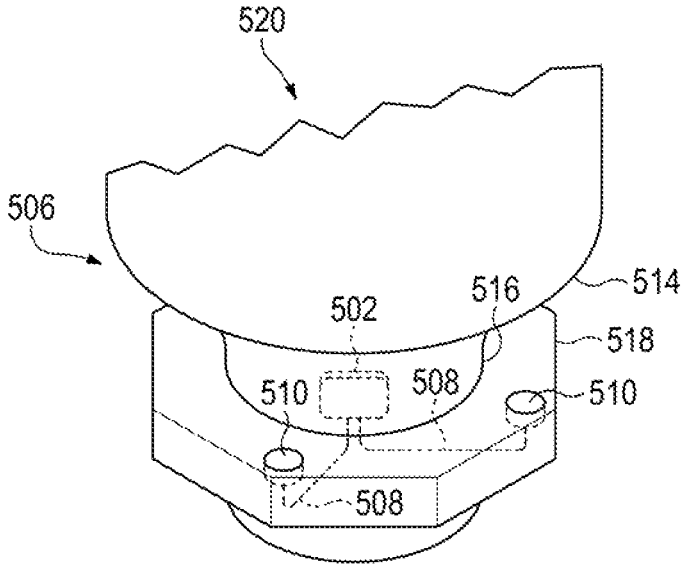

Referring to FIG. 5, the memory resource 502 is embedded in a wall 512 of the neck 516 of the housing 506 of the container 520. Electrical contacts 510 are asymmetrically located on adjacent sides of an exterior surface of the rim 518 facing towards the body 514 and coupled to the memory resource 502 via electrical leads 508. The rim 518 may define a port coupled to a channel in the neck 516 coupled to a print material chamber in the body 514. In this manner, the memory resource 502 may be embedded in a wall of the neck 516 defining a channel between the print material chamber and the output port of the container. The shape of the rim 518, the neck 516, and/or the body 514 may act as a guideway or guideway counterpart to support rotation of the print material container 520 about an axis in a placement direction.

By embedding a memory resource with information about the print material container, the memory resource is protected by the container housing, for example. In this manner, the memory resource and the data stored thereon may maintain a level of integrity suitable for use with a print component and/or print apparatus. As an example, a secure smart-chip embedded in a container may provide data to a print apparatus to inform the device of attributes or features of the colorant or other particulates related to the colorant of the container to the device or cartridge. Example attributes or features may include chamber volume, mass of print material, print material remaining, print material type, print material characteristics, chemical composition, metallurgy, stir-rate integrity, and the like. The memory resource location for molding-in may be in an intricate or hard-to-reach location (e.g., unreachable without specialized equipment or significant container manipulation) during manufacturing that make integration with a colorant container (e.g., colorant container 520) without specialized equipment difficult. The memory resource may be located on a non-visible location within the molding of the print component or colorant container with electrical leads molded into the containers to limit the likelihood of a counterfeit chip being added after the manufacturing process, and a remote connection, via the electrical leads, to the print device or component may be established when physical contact and electrical conduction is made. By providing an electrical connection to the memory resource embedded in the print material container, information provided in the memory resource may be retrievable by a compute system to perform an operation of the print apparatus based on the information on the memory resource, for example.

The memory resources discussed herein may be a passively accessible storage medium or may be part of an active system capable of retrieving and sending data of the storage medium. For example, a component shell (into which fits the container) may include a processor resource electrically coupled to an electrical contact of the component shell in electrical communication with an electrical contact of the container such that the processor resource of the component shell is able to retrieve data from the memory resource of the container.

Figure 6:
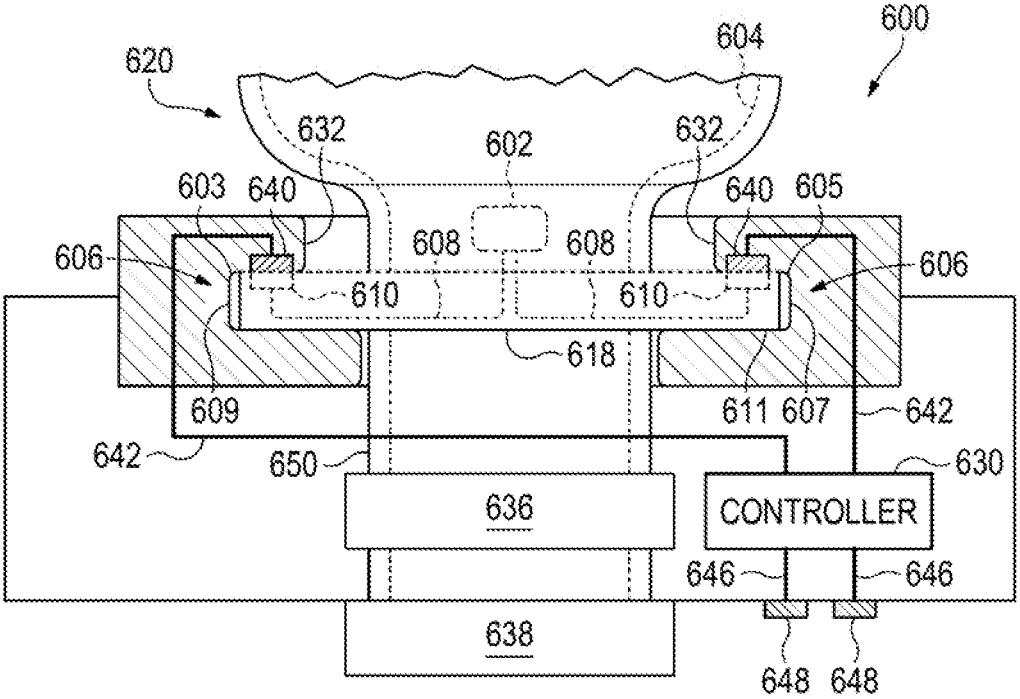
FIG. 6 is a sectional view of an example container coupled to an example component.

FIG. 6 is a sectional view of an example print material container 620 coupled to an example component 600. The print material container 620 is in a rotated state such that an electrical connection and a material transfer connection is made between the print material container 620 and the print component 600. The guideway 606 allows for rotation of the rim 618 to guide the electrical contacts 610 towards electrical contacts 640. The guideway 608 may include guide walls 603, 605, 607, 609, and 611 that may guide rotation of the print material container 620 about an axis of a placement direction into the guide way cavity. For example, the lip 632 may allow for insertion of the print material container into the space of the guideway 606 and the cavity of the guideway as defined by the guide walls 603, 605, 607, 609, and 611 may allow for and guide rotation of the rim 618 into the position depicted in FIG. 6.

The print material of the container 620 is transferable from the print material chamber 604 to an input port 636 of the component (e.g., via a channel of the neck of the container coupled to the chamber). The input port 636 is coupled to an output port 638 of the component 600 to transfer the print material to a print apparatus (e.g., the port of a toner component is able to be sealed and coupled to a toner receiving station of a print apparatus in a manner capable of print material transfer). For example, the container 620 may define a port 650 (e.g., coupled to or part of a rim of the container) coupled to the print material chamber 604 that is sealingly coupleable (e.g., able to be coupled in a manner that generates a seal) to a port 636 of a component 600, where the component 600 may be able to dispense print material from the print material chamber 604 to output port 638 via the connection between the container port 650 and the input port 636 of the component 600.

The print material container 620 is coupled to the print component 600 via a container interface. The container interface may include a print material transfer interface as described above and an electrical interface. In an example, the container 620 is a coupled to a shell of the component with a recessed interface to receive a rim of the container 620. In that example, an electrical contact on the component may be placed in a complementary location to the electrical contact of the container when the container is sealingly coupled to the recessed interface.

The print material container 620 includes a memory resource 602 and an electrical contact 610 coupled to the memory resource 602 via an electrical lead 608. When the print material container 620 is moved to the contact position, the electrical contact 610 aligns towards the electrical contact 640 of the print component 600. The electrical contact 640 of the component is electrically coupled to the controller 630 via electrical lead 642. The controller 630 is electrically coupled, via electrical lead 646, to the electrical contact 648 on the exterior of the component 600 at an electrical interface for a print apparatus. The controller 630 coupled to the component shell may include a processor resource electrically coupled to the electrical contact 640 on the component shell so that the processor resource is able to retrieve data from the memory resource 602. The electrical leads 608 may be connected to a communication interface of the memory resource 602 and/or connected to a power interface of the memory resource 602. As used herein, a communication interface is any appropriate circuitry to enable preparation of signals and/or transmission of signals along an electrical path. A power interface, as used herein, may refer to any appropriate circuitry to enable transfer of electrical power along an electrical path, including a ground connection for example. In some examples, the controller 630 may communicate data and provide power to the memory resource 602 over the same electrical path, such as manipulating characteristics of the signal to encode data.

The controller 630 may include a set of instructions that when executed cause the controller to retrieve data from the memory resource 602 of the print material container 620 via a first group of electrical leads 642 between the controller 630 and the electrical contacts 640 and provide a signal, via a second group of electrical leads 646, to the electrical contacts 648 where the signal corresponds to the data retrieved from the memory resource 602 of the print material container. In this manner, the controller 630 may provide (e.g., relay or actively transmit) the signal to be received by a print apparatus via an electrical connection with the electrical contacts 648 when the print component 600 is electronically coupled to a print material receiving station of the print apparatus.

The component shell may include a recess or other exterior surface that defines a guide feature to guide connection of the container to a receiving area such that the guide feature guides the electrical contact of the container towards an electrical contact of the receiving area. For example, the guide feature may be a recess that guides movement of electrical contacts of the container towards electrical contacts of the component (located inside the recess) upon insertion of the container into the recess of the component. For another example, the guide feature may be a protrusion with electrical contacts located thereon that align with electrical contacts on an exterior surface of the container when the mechanical port of the container mates with the protrusion of the component shell upon directing the container towards the component at the location of the protrusion.

The print component 600 may include a lip 632 protruding from a side wall defining a boundary of the recess to which the print material container 620 is insertable. The plurality of electrical contacts 640 of the print component 600 may be located on the lip 632 facing into the recess (e.g., facing a base wall defining a boundary of the recess). The lip 632 may be spaced apart from a base wall of the recess about a distance substantially equivalent to a width of a rim 618 of a print material container 620. The rim 618 of the print material container 620 may be shaped to be insertable into the recess at a first orientation and rotatable to a second orientation to align the plurality of electrical contacts 610 of the print material container 620 with the plurality of electrical contacts 640 on the print component 600. The plurality of electrical contacts 610 of the print material container 620 are located on a surface of the rim 618 facing away from the base wall of the recess when the print material container 620 is inserted into the recess.

In some examples, there may be a number of electrical contacts to, for example, provide obfuscation to electrical operation between the print material container and the print component. For example, a number of electrical contacts of the print component may be different from a number of electrical contacts of the print material container. In one example, a number of potential electrical contacts of the component is greater than the number of electrical contacts of the print material container.

The controller 630 may comprise a memory resource operatively coupled to a processor resource. A memory resource may contain a set of instructions that are executable by the processor resource and the set of instructions are operable to cause the processor resource to perform operations of a control program when the set of instructions are executed by the processor resource. For example, the processor resource may execute the set of instructions corresponding to a control program to perform communication operations to retrieve data from a memory resource or pass data from the memory resource 602, such as container data, to another processor resource or storage location.

A processor resource is any appropriate circuitry capable of processing (e.g., computing) instructions, such as one or multiple processing elements capable of retrieving instructions from a memory resource and executing those instructions. For example, the processor resource may be a central processing unit (CPU) that enables container data retrieval by fetching, decoding, and executing modules of instructions. Example processor resources include at least one CPU, a semiconductor-based microprocessor, a programmable logic device such as an application specific integrated circuit (ASIC), and the like. A processor resource may include multiple processing elements that are integrated in a single device or distributed across devices. A processor resource may process the instructions serially, concurrently, or in partial concurrence.

A memory resource represents a medium to store data utilized and/or produced by a print component or print apparatus. The medium is any non-transitory medium or combination of non-transitory media able to electronically store data. For example, the medium may be a storage medium, which is distinct from a transitory transmission medium, such as a signal. The medium may be machine-readable, such as computer-readable. The medium may be an electronic, magnetic, optical, or other physical storage device that is capable of containing (i.e., storing) executable instructions. A memory resource may be integrated in the same device as a processor resource or it may be separate but accessible to that device and the processor resource. A memory resource may be distributed across devices. A memory resource may be a non-volatile memory resource such as read-only memory (ROM), a volatile memory resource such as random-access memory (RAM), a storage device, or a combination thereof.

FIGS. 7A-9B are top views of an example interface states between example print components 700, 800, and 900 and example print material containers 720, 820, and 920.

Figure 7A:
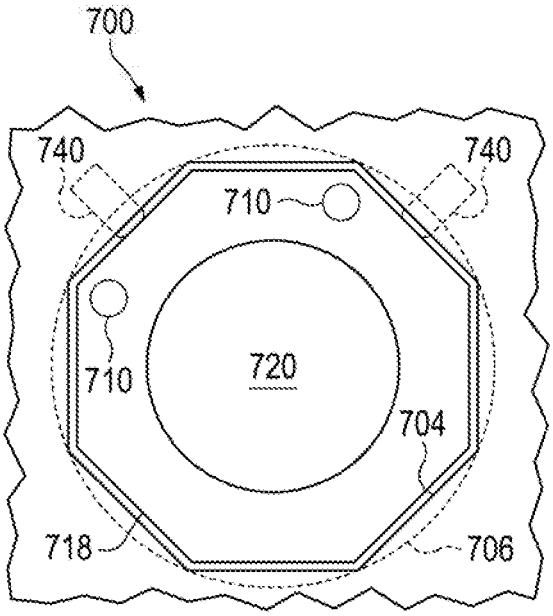
FIGS. 7A-9B are top views of example interface states between example print components and example print material containers.
Figure 7B:
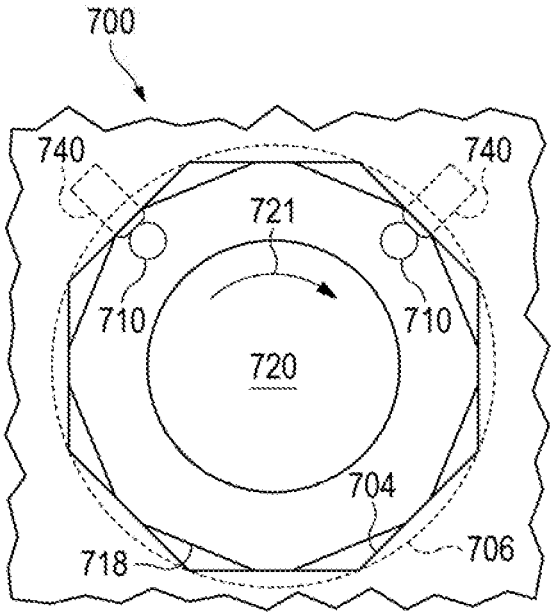

Referring to FIG. 7A, the print material container 720 is inserted into a print component 700. The rim 718 of the print material container 720 is of a similar octagonal shape to the recess 704 defined by the housing of the print component 700. The electrical contacts 710 of the print material container 720 are not in contact with the electrical contacts 740 of the print component 700 in the state depicted in FIG. 7A. Upon rotation in the direction 721, the electrical contacts 710 of print material container 720 move towards electrical contacts 740 of the print component 700. In the state depicted in FIG. 7B, the electrical contacts 710 of the print material container 720 moved into a position to be in electrical connection with electrical contacts 740 of the print component 700. The rotation 721 is guided by a guide wall 706. In this manner, the guide wall 706 supports rotation of the print material container 720 about an axis in a placement direction through the recess 704. The rotation 721 may be about the central axis of the container 720. Though not included in the figures herein, visual features, such as arrows or lines to show alignment, may be used as a visual cue to indicate accurate insertion and rotation to the desired orientation. For example, an arrow may be placed on the component surface and the container may be rotated until an arrow on the container aligns with the arrow on the component.

Figure 8A:
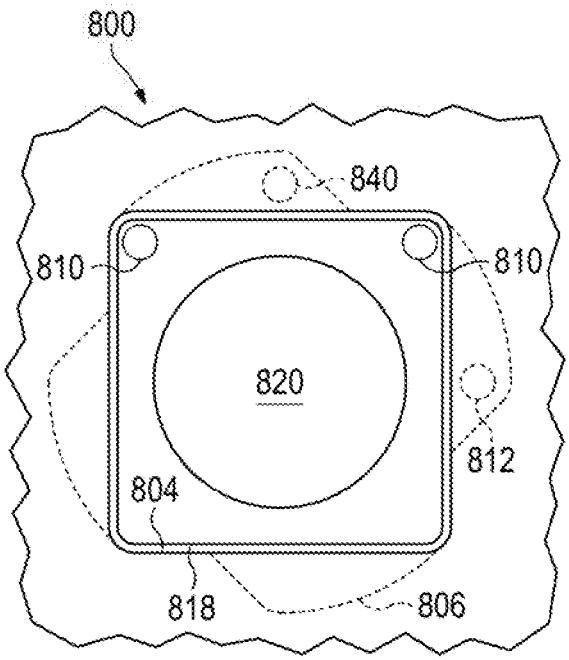
Figure 8B:
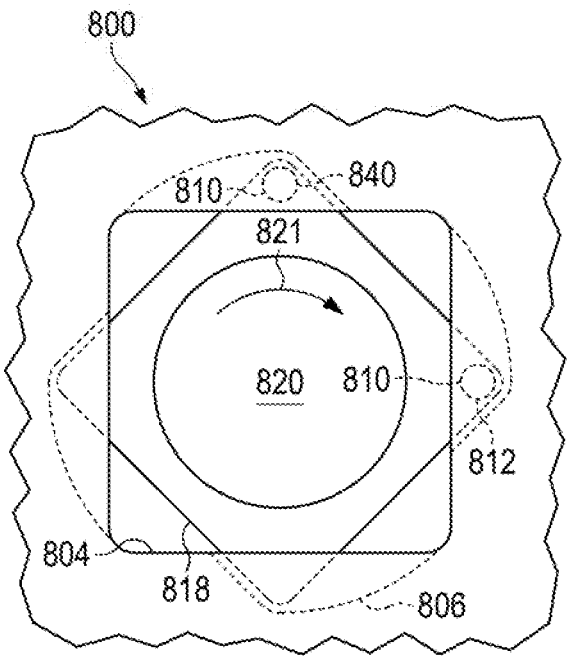

Referring to FIG. 8A, the print material container 820 is inserted into a print component 800. The rim 818 of the print material container 820 is of a similar quadrilateral shape to the recess 804 defined by the housing of the print component 800. The electrical contacts 810 of the print material container 820 are not in contact with the electrical contacts 840 of the print component 800 in the state depicted in FIG. 8A. Upon rotation in the direction 821, the electrical contacts 810 of print material container 820 move towards electrical contacts 840 of the print component 800. In the state depicted in FIG. 81, the electrical contacts 810 of the print material container 820 moved into a position to be in electrical connection with electrical contacts 840 of the print component 800. The rotation 821 is guided by a guide wall 806 that guides the container 820 to rotate until the appropriate electrical connection is made between electrical contacts 810 and 840.

Figure 9A:
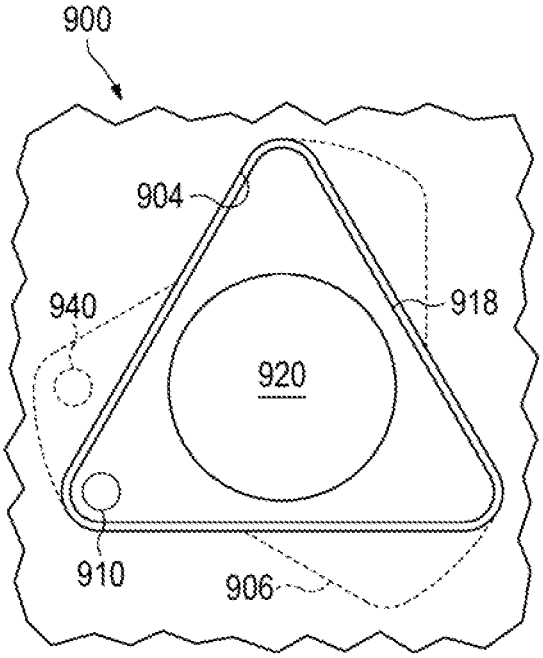
Figure 9B:
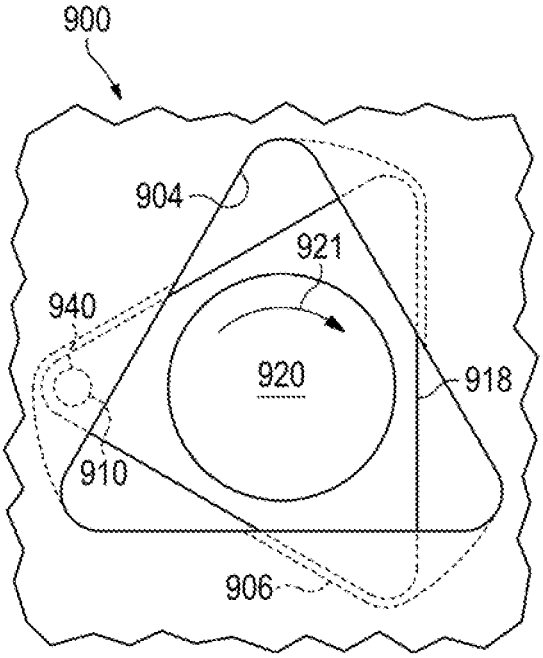

Referring to FIG. 9A, the print material container 920 is inserted into a print component 900. The rim 918 of the print material container 920 is of a similar triangular shape to the recess 904 defined by the housing of the print component 900. The electrical contact 910 of the print material container 920 is not in contact with the electrical contact 940 of the print component 900 in the state depicted in FIG. 9A. Upon rotation in the direction 921, the electrical contact 910 of print material container 920 moves towards electrical contact 940 of the print component 900. In the state depicted in FIG. 9B, the electrical contact 910 of the print material container 920 moved into a position to be in electrical connection with electrical contact 940 of the print component 900. In this manner, a protrusion including the electrical contact 910 rotates into a position to make an electrical connection with the component 900. The rotation 921 is guided by a guide wall 906 that guides the container 920 to rotate until the appropriate electrical connection is made between electrical contacts 910 and 940.

Figure 10:
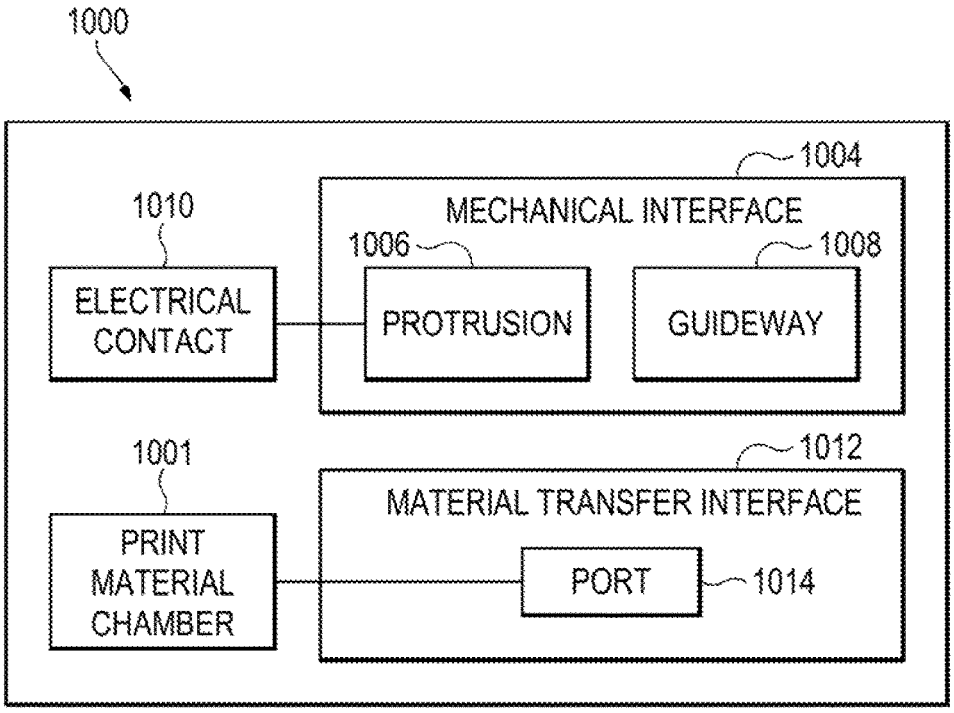
FIGS. 10 and 11 are block diagrams depicting example containers.
Figure 11:
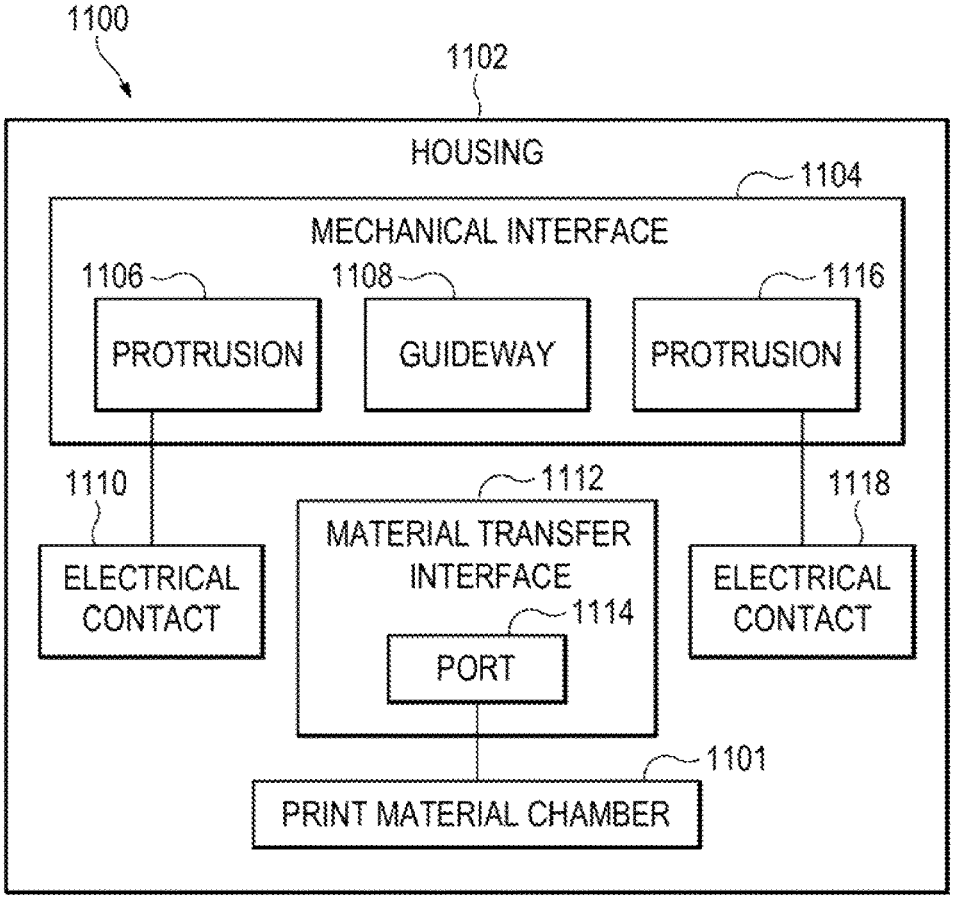

FIGS. 10 and 11 are block diagrams depicting example containers 1000 and 1100. The containers 1000 and 1100 may be print material containers, such as print material containers discussed earlier herein. For example, the container 1000 may include a print material chamber 1001 to hold print material. For another example, the container 1100 may include a housing 1102 defining a print material chamber 1101 to hold and transfer a supply of print particles, such as laser toner.

Referring to FIG. 10, the container 1000 may include a material transfer interface 1012 defining a port 1014 coupled to the print material chamber 1001. The material transfer interface 1012 may include a channel to transfer print material from the print material chamber 1001 to the exterior of the print material container 1000 (e.g., into a print component or a print material delivery system of a print apparatus).

The print material container 1000 may include a mechanical interface 1004. The mechanical interface 1004 may include a guide structure defining a protrusion 1006 and a guideway 1008 to allow the container to rotate within a recess defined by a shell associated with a print receptacle of a host device. For example, the neck of the container, such as the neck 316, 416, or 516 of FIGS. 3-5, may act as a guideway that supports rotation of the print material container about an axis of a placement direction. In other examples, the rim of the container, such as rim 318, 18, and 518 of FIGS. 3-5 may act as a guideway counterpart that supports rotation of the print material container about an axis of a placement direction. An electrical contact 1010 may be coupled to the protrusion 1006 of the guide structure. Upon rotation of the container 1000, the electrical contact 1010 moves towards an electrical contact on a shell associated with a receptacle (e.g., into which the container 100 is inserted).

Referring to FIG. 11, the container 1100 may include a material transfer interface 1112 and a mechanical interface 1104 similar to the material transfer interface 1012 and the mechanical interface 1004 of FIG. 10 with an additional protrusion 1116 included in the mechanical interface 1104 and an additional electrical contact 1118 coupled to the protrusion 1116. For example, the second protrusion 1116 defined by the mechanical interface may be symmetrically located with respect to the first protrusion 1106 such that the electrical contact 1116 is symmetrically located on second protrusion 1116. For another example, the second protrusion 1116 defined by the mechanical interface may asymmetrically located with respect to the first protrusion 1106 such that the electrical contact 1116 is asymmetrically located on second protrusion 1116.

The housing 1102 may define or be coupled to the mechanical interface 1104, the material transfer interface 1112, and/or the print material chamber 1101. The housings discussed herein, such as housing 1102, may be made of any appropriate material formable into a container. For example, a polymer composite may be used to form the housing to define a print material chamber and a guide structure. Example plastic polymers may include thermoplastic polymers such as acrylonitrile butadiene styrene (ABS), synthetic resins such as vinyl, semi-synthetic organic compounds, organic polymers, and the like. Other appropriate structural materials useable to form the housing include metal, plastic, ceramic, glass, rubber, and the like, or any composite thereof. The guide structures (such as the guideways and guide walls discussed herein as well as any other portion of the housing as discussed herein) may be made of the same structural material as the remainder of the housing or may be made of different structural material.

By implementing a print material container and/or the print component with a guide structure that enables movement of electrical contact upon rotation, a proper electrical connection may be, for example, ensured between the print material container and the print component.

All of the features disclosed in this specification (including any accompanying claims, abstract and drawings), and/or all of the elements of any method or process so disclosed, may be combined in any combination, except combinations where at least some of such features and/or elements are mutually exclusive.

The terms "include," "have," and variations thereof, as used herein, mean the same as the term "comprise" or appropriate variation thereof. Furthermore, the term "based on," as used herein, means "based at least in part on." Thus, a feature that is described as based on some stimulus may be based only on the stimulus or a combination of stimuli including the stimulus. Furthermore, the use of the words "first," "second," or related terms in the claims are not used to limit the claim elements to an order or location, but are merely used to distinguish separate claim elements.

The present description has been shown and described with reference to the foregoing examples. It is understood, however, that other forms, details, and examples may be made without departing from the spirit and scope of the following claims.

What is claimed is:

1. A print component comprising:

a guide structure defining:

a recess in a placement direction to receive a print material container having a plurality of electrical contacts;

a guideway adjacent the recess, the guideway including a guide wall to support rotation of the print material container about an axis of the placement direction; and a lip protruding from a side wall defining a boundary of the recess and spaced apart from a base wall of the recess about a distance substantially equivalent to a width of a rim of the print material container; and a plurality of electrical contacts coupled to the guide structure and located on the lip facing into the recess, the guideway to guide the plurality of electrical contacts of the print material container to move towards the plurality of electrical contacts of the print component upon rotation of the print material container about the axis of the placement direction, wherein the rim of the print material container is shaped to be insertable into the recess at a first orientation and rotatable to a second orientation to align the plurality of electrical contacts of the print material container with the plurality of electrical contacts on the print component.

2. The print component of claim 1, comprising:

a material transfer interface defining a port coupleable to a print material chamber of the print material container.

3. The print component of claim 2, wherein:

the rotation of the print material container is about an axis of the material transfer interface;

the rotation of the print material container generates an electrical connection between the print material container and the print component; and the rotation of the print material container generates a seal between the print material container and the print component.

4. The print component of claim 1, wherein:

the plurality of electrical contacts of the print component are located on a surface of the lip facing the base wall of the recess; and the plurality of electrical contacts of the print material container are located on a surface of the rim facing away from the base wall of the recess when the print material container is inserted into the recess.

5. The print component of claim 4, wherein:

the plurality of electrical contacts of the print component are located adjacent to each other on a same side of the side wall of the recess.

6. The print component of claim 4; wherein:

the plurality of electrical contacts of the print component are located across from each other on substantially opposing side walls of the recess.

7. The print component of claim 1, wherein:

a number of electrical contacts of the print component is different from a number of electrical contacts of the print material container.

8. The print component of claim 1, comprising a controller electrically coupled to the plurality of electrical contacts of the print component.

9. The print component of claim 8, comprising an electrical lead coupled to the controller to provide a signal from the controller.

10. The print component of claim 9, wherein the controller is to retrieve data from the print material container and provide the retrieved data as the signal from the controller.

11. The print component of claim 9, wherein the controller includes a memory resource.

12. A print particle supply container to supply print particles to a print particle receptacle of a host device, the print particle supply container comprising:

a print material chamber;

a material transfer interface including a port coupled to the print material chamber;

a mechanical interface including a guide structure defining:

a first protrusion;

a second protrusion, the second protrusion being symmetrically or asymmetrically located with respect to the first protrusion; and a guideway to allow the print particle supply container to rotate within a recess defined by a shell associated with the print particle receptacle;

a first electrical contact coupled to the first protrusion of the guide structure, the first electrical contact of the guide structure to move towards a first electrical contact on the shell upon rotation of the print particle supply container; and a second electrical contact located on the second protrusion.

13. The print particle supply container of claim 12, comprising a channel to transfer print material from the print material chamber to an exterior of the print particle supply container.

14. The print particle supply container of claim 12, wherein the guideway comprises a neck or a rim of the mechanical interface.

15. The print particle supply container of claim 12, wherein the mechanical interface includes a housing of the print particle supply container.

16. The print particle supply container of claim 15, wherein the housing includes at least one of acrylonitrile butadiene styrene (ABS), vinyl, a semi-synthetic organic compound, an organic polymer, metal, plastic, ceramic, glass, or rubber.

* * * * *